US007571573B2

(12) United States Patent
Moller, Jr.

(10) Patent No.: US 7,571,573 B2
(45) Date of Patent: Aug. 11, 2009

(54) MODULAR FLOOR TILE WITH LOWER CROSS RIB

(76) Inventor: Jorgen J. Moller, Jr., 3043 E. Brighton Pl., Salt Lake City, UT (US) 84121

( * ) Notice: Subject to any disclaimer, the term of this patent is extended or adjusted under 35 U.S.C. 154(b) by 283 days.

(21) Appl. No.: 11/402,178

(22) Filed: Apr. 11, 2006

(65) Prior Publication Data

US 2007/0261317 A1 Nov. 15, 2007

(51) Int. Cl.
*E04F 15/16* (2006.01)

(52) U.S. Cl. ..... 52/177; 52/392; 52/302.4; 52/591.1; 472/92

(58) Field of Classification Search ..... 52/177, 52/386, 390–392, 591.1, 591.2, 592.1, 747.11, 52/403.1, 302.3, 302.4, 664; 404/41; 472/92; 119/526, 527, 530; 15/215, 238; D12/203; D6/582

See application file for complete search history.

(56) References Cited

U.S. PATENT DOCUMENTS

| | | | | |
|---|---|---|---|---|
| 738,704 | A | 9/1903 | Semmer | |
| 1,420,775 | A | 6/1922 | Stanwood | |
| 1,625,187 | A | 4/1927 | Birch | |
| D93,991 | S | 12/1934 | Moore | |
| 3,015,136 | A | 1/1962 | Doe | |
| 3,093,870 | A | 6/1963 | Brock | |
| 3,196,763 | A | 7/1965 | Rushton | |
| 3,279,138 | A | 10/1966 | Dittmar | |
| 3,284,819 | A | 11/1966 | Nissen | |
| 3,319,392 | A | 5/1967 | Fitzgerald | |
| 3,452,497 | A | 7/1969 | Warp | |
| 3,717,247 | A | 2/1973 | Moore | |
| 3,721,215 | A * | 3/1973 | Vickstrom et al. | 119/529 |
| 3,730,140 | A * | 5/1973 | Bowser et al. | 119/529 |
| 3,741,411 | A | 6/1973 | Peacock | |
| 3,861,592 | A | 1/1975 | Fisher | |
| 3,909,996 | A | 10/1975 | Ettinger, Jr. et al. | |
| 3,913,291 | A * | 10/1975 | Dulien et al. | 52/396.04 |
| 4,087,948 | A * | 5/1978 | Mellor | 52/180 |
| 4,133,481 | A | 1/1979 | Bennett | |
| 4,211,366 | A | 7/1980 | Czarnota | |
| 4,226,060 | A | 10/1980 | Sato | |
| 4,287,693 | A | 9/1981 | Collette | |
| 4,436,779 | A | 3/1984 | Menconi et al. | |
| 4,438,726 | A * | 3/1984 | Osthoff | 119/450 |
| D274,588 | S * | 7/1984 | Swanson et al. | D6/582 |
| D274,948 | S * | 7/1984 | Swanson et al. | D25/156 |
| 4,543,765 | A | 10/1985 | Barrett | |
| 4,584,221 | A * | 4/1986 | Kung | 428/44 |
| 4,590,731 | A * | 5/1986 | DeGooyer | 52/581 |

(Continued)

FOREIGN PATENT DOCUMENTS

| | | | |
|---|---|---|---|
| GB | 2262437 | A | 6/1993 |

*Primary Examiner*—Robert J Canfield
*Assistant Examiner*—James J Buckle, Jr.
(74) *Attorney, Agent, or Firm*—Holland & Hart

(57) ABSTRACT

The principles described herein provide floor tiles and modular floors. The floor tiles may include small steps in a surface structure to increase traction. The floor tiles may also or alternatively include diagonal cross ribs to block the passage of debris and break liquid surface tension. The modular tiles may be injection molded. The floor tiles may also provide multiple layers of traction, providing more sure footing than previous flooring systems. The floor tiles may provide multiple layers of traction, providing more sure footing than previous flooring systems.

28 Claims, 4 Drawing Sheets

U.S. PATENT DOCUMENTS 4,715,743 A 12/1987 Schmanski
4,860,510 A * 8/1989 Kotler ..... 52/177
4,930,286 A * 6/1990 Kotler ..... 52/177
5,014,488 A 5/1991 Evangelos et al.
5,033,241 A 7/1991 Max
D336,348 S * 6/1993 Dorfman, Jr. ..... D25/156
5,275,502 A 1/1994 Glaza
5,323,575 A * 6/1994 Yeh ..... 52/177
D356,709 S * 3/1995 Scott ..... D6/585
5,527,128 A 6/1996 Rope et al.
5,628,160 A * 5/1997 Kung ..... 52/591.1
D383,253 S 9/1997 Semenuk
D385,974 S 11/1997 Berger
D385,978 S 11/1997 Berger
5,787,654 A * 8/1998 Drost ..... 52/177
5,807,021 A 9/1998 Aaron
5,815,995 A 10/1998 Adam
5,833,386 A 11/1998 Rosan et al.
5,904,021 A * 5/1999 Fisher ..... 52/578
5,950,377 A * 9/1999 Yoder ..... 52/177
5,950,378 A 9/1999 Council
5,992,106 A * 11/1999 Carling et al. ..... 52/177
6,047,663 A * 4/2000 Moreau et al. ..... 119/529
6,061,979 A 5/2000 Johannes
6,098,354 A * 8/2000 Skandis ..... 52/177
D456,533 S 4/2002 Moller, Jr.
D462,792 S 9/2002 Ogawa
6,467,224 B1 * 10/2002 Bertolini ..... 52/177
6,526,705 B1 3/2003 MacDonald
6,585,449 B2 * 7/2003 Chen ..... 404/2
D481,470 S 10/2003 Moller, Jr.
6,751,912 B2 6/2004 Stegner et al.
6,802,159 B1 10/2004 Kotler
D499,189 S * 11/2004 Collison ..... D25/62
6,878,430 B2 4/2005 Milewski et al.
6,966,155 B2 * 11/2005 Nevison ..... 52/177
D516,737 S 3/2006 Moller, Jr.
D522,067 S * 5/2006 Allen ..... D21/321
7,114,298 B2 * 10/2006 Kotler ..... 52/177
D532,122 S * 11/2006 Shuman et al. ..... D25/163
D532,530 S * 11/2006 Shuman et al. ..... D25/163
7,211,314 B2 * 5/2007 Nevison ..... 428/143
D553,264 S * 10/2007 Shin et al. ..... D25/156
7,299,592 B2 * 11/2007 Moller, Jr. ..... 52/180
2002/0122912 A1 * 9/2002 Brock et al. ..... 428/44
2002/0189176 A1 * 12/2002 Stegner et al. ..... 52/177
2003/0089051 A1 * 5/2003 Bertolini ..... 52/177
2005/0193669 A1 * 9/2005 Zdeblick et al. ..... 52/392
2006/0070314 A1 * 4/2006 Jenkins et al. ..... 52/177
2007/0289244 A1 * 12/2007 Haney et al. ..... 52/539

* cited by examiner

MODULAR FLOOR TILE WITH LOWER CROSS RIB

TECHNICAL FIELD

This relates generally to floor tiles, and more particularly to modular floor systems.

BACKGROUND

Floor tiles have traditionally been used for many different purposes, including both aesthetic and utilitarian purposes. For example, floor tiles of a particular color may be used to accentuate an object displayed on top of the tiles. Alternatively, floor tiles may be used to simply protect the surface beneath the tiles from various forms of damage. Floor tiles typically comprise individual panels that are placed on the ground either permanently or temporarily depending on the application. A permanent application may involve adhering the tiles to the floor in some way, whereas a temporary application would simply involve setting the tiles on the floor. Some floor tiles can be interconnected to one another to cover large floor areas such as a garage, an office, or a show floor. Other interconnected tile systems are used as dance floors and sports court surfaces.

Some floor tiles have open top surfaces. The open surfaces allow water or other liquids to pass through the tile to the ground rather than pool on top of the tiles. However, these open surfaces also permit debris to fall below the open top surfaces. For example, leaves often fall onto outdoor floor tiles and tend to slip through the holes of the open top surface. Leaves that slip through the holes often get stuck below the tile. The leaves and other debris stuck under the tile reduce the aesthetic appeal of the floor and can be difficult to remove without partially or fully disassembling the floor.

In addition, the top surface of typical interconnected tile systems can be slippery. Various surface structures have been utilized with the interconnected tile systems to increase traction and reduce the occurrence of slipping accidents. Some tile systems include solid top surfaces with raised features. The raised features include raised circles and diamond patterns. Other tile systems, particularly sports-related tile systems with open top surfaces, have no additional features to increase traction. Therefore, there is a need for modular interconnected tile systems that include open top surfaces that block the passage of some debris and provide for increased traction.

SUMMARY

Some embodiments address the above-described needs and others. In one of many possible embodiments, a modular floor tile is provided. The modular floor tile comprises a first open surface, a plurality of edge surfaces, an interlocking mechanism for attachment to adjacent tiles, and a plurality of crossing surface members defining the first open surface. Each of the plurality of crossing surface members comprises a central top portion and opposing side portions, and a step disposed in the side portions. In one embodiment, the step disposed in the side portions is a step down from the central top portion. In one embodiment, the step disposed in the side portions is a generally square step down from the central top portion.

In one embodiment, of the modular floor tile, the plurality of crossing surface members comprise a first set of spaced ribs generally parallel to a first of the plurality of edge surfaces, and a second set of spaced ribs generally parallel to a second of the plurality of edge surfaces. In one embodiment, the first and second edge surfaces are orthogonal. One embodiment includes a protrusion extending from each intersection between the first and second sets of spaced ribs. The protrusion may be generally circular.

In one embodiment, of the modular floor tile, the first open surface comprises a rectangle, and the plurality of crossing surface members form a plurality of congruent rectangles. In one embodiment, the first open surface comprises a square, and the plurality of crossing surface members form a plurality of congruent squares. In one embodiment, the first open surface comprises a first elevation, and a cross rib extends between the crossing surface members at a second elevation below the first elevation. In one embodiment, the cross rib extends diagonally between the crossing surface members at the second elevation.

In one embodiment, of the modular floor tile, the plurality of crossing surface members comprise a first set of spaced ribs generally parallel to a first of the plurality of edge surfaces a second set of spaced ribs generally parallel to a second of the plurality of edge surfaces. In one embodiment, the first and second edge surfaces are orthogonal. The first and second sets of ribs form a plurality of rectangles, and a lower rib extends diagonally between each of the plurality of rectangles at an elevation below the first open surface.

One embodiment provides an apparatus, the apparatus comprising a modular floor. One embodiment of the modular floor comprises a plurality of interlocking tiles, each of the plurality of interlocking tiles comprising a top surface including a plurality of open holes, and a lower rib disposed across each of the plurality of open holes at an elevation below the top surface. In one embodiment, each of the plurality of interlocking tiles comprises four edge surfaces forming a rectangle, and the lower rib is arranged diagonal to the four edge surfaces. In one embodiment, the open holes are defined by a plurality of crossing members forming squares, and the lower rib is arranged diagonal to the squares. In one embodiment, the open holes are defined by a plurality of crossing members forming squares, each of the crossing members having edges comprising a step down from the top surface.

One embodiment provides another apparatus, the apparatus comprising a modular floor. The modular floor comprises a plurality of interlocking tiles, each of the plurality of interlocking tiles comprising a top surface structure having a plurality of open holes, and a leaf-blocking member disposed across each of the plurality of open holes at an elevation below the top surface. In one embodiment, the leaf blocking member is sized to block leaves of 0.25 inches across and larger from passing through the open holes. In one embodiment, the leaf blocking member comprises a rib extending diagonally across each of the plurality of open holes. In one embodiment, the leaf blocking member is non-parallel to any sides of the interlocking tiles. In one embodiment, each of the interlocking tiles further comprises a step in each edge of the top surface structure.

One embodiment provides an apparatus comprising a rectangular modular tile. The rectangular modular tile comprises a top surface having a plurality of open holes, four edge surfaces defining a perimeter of the rectangular tiles, and a rib disposed across each of the plurality of open holes in a non-parallel orientation with respect to any of the four edge surfaces. In one embodiment, the rectangular modular tile comprises a square. In one embodiment, the rib is oriented between approximately 20 and 70 degrees with respect to the four edge surfaces. In one embodiment, the rib is oriented at approximately 45 degrees with respect to the four edge surfaces. In one embodiment, the rib is diagonal to the four edge surfaces. In one embodiment, the rib comprises a lower elevation than the top surface. In one embodiment, the top surface comprises a plurality of rectangles, each rectangle comprising an inside and an outside edge, wherein each of the inside and outside edges comprise a step. In one embodiment, the step is 0.0725 inches down from the top surface. One embodiment comprises a plurality of the rectangular modular tiles interconnected to form a sports court, each of the plurality of rectangular modular tiles comprising a top surface comprising a plurality of open holes, four edge surfaces defining a perimeter of the rectangular tiles, a rib disposed across each of the plurality of open holes in a non-parallel orientation with respect to any of the four edge surfaces, and a step in all side edges defining the plurality of open holes.

The foregoing features and advantages, together with other features and advantages, will become more apparent when referring to the following specification, claims and accompanying drawings.

BRIEF DESCRIPTION OF THE DRAWINGS

The accompanying drawings illustrate various embodiments and are a part of the specification. The illustrated embodiments are merely examples and do not limit the claims.

DETAILED DESCRIPTION

Illustrative embodiments and aspects of the invention are described below. It will of course be appreciated that in the development of any such actual embodiment, numerous implementation-specific decisions must be made to achieve the developers' specific goals, such as compliance with system-related and business-related constraints, that will vary from one implementation to another. Moreover, it will be appreciated that such a development effort might be complex and time-consuming, but would nevertheless be a routine undertaking for those of ordinary skill in the art having the benefit of this disclosure.

The present invention contemplates, among other things, floors and modular floor tiles. As mentioned above, typical modular flooring often includes open top surfaces that tend to be slippery and allow leaves and other debris to pass through and get stuck underneath. The leaves and debris can collect into an unsightly mess. In addition, the slippery surfaces often associated with typical flooring compromises the footing of users, especially sports court users that tend to start and stop abruptly. The typical modular floor offers less than ideal traction to dance, sport, pedestrian, and other traffic. The principles described herein present methods and apparatus that provide better traction and catch more debris than previous flooring systems. However, the application of the principles described herein is not limited to the specific embodiments shown. The principles described herein may be used with any flooring system. Moreover, although certain embodiments shown incorporate multiple novel features, the features may be independent and need not all be used together in a single embodiment. Tiles and flooring systems according to principles described herein may comprise any number of the features presented. Therefore, while the description below is directed primarily to interlocking plastic modular floors, the methods and apparatus are only limited by the appended claims.

As used throughout the claims and specification, the term "modular" refers to objects of regular or standardized units or dimensions, as to provide multiple components for assembly of flexible arrangements and uses. A "step" refers to a change in elevation, a ledge, or an offset. A "rib" is a part or piece serving to shape or support, a framework. "Diagonal" means having a slanted or oblique direction. The words "including" and "having," as used in the specification, including the claims, have the same meaning as the word "comprising."

Figure 1:
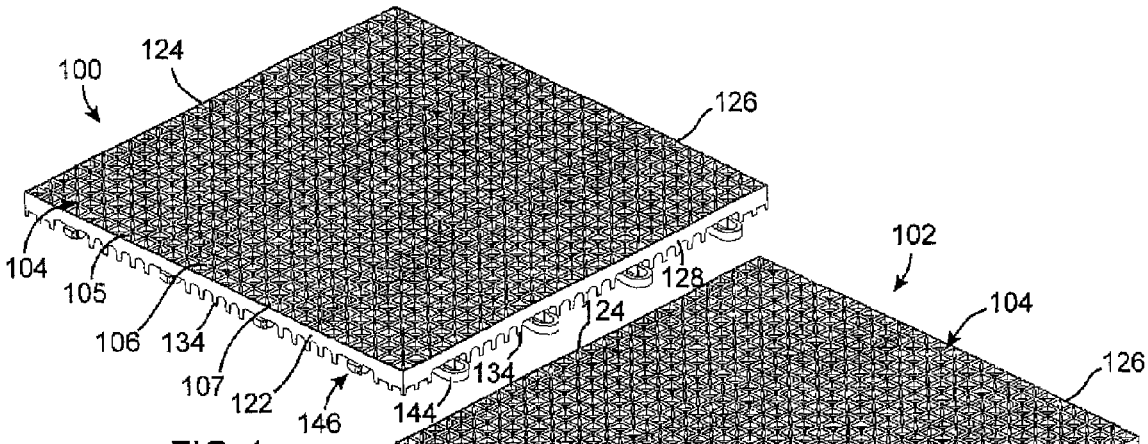
FIG. 1 is a perspective assembly view of two modular floor tiles according to one embodiment.
Figure 3:
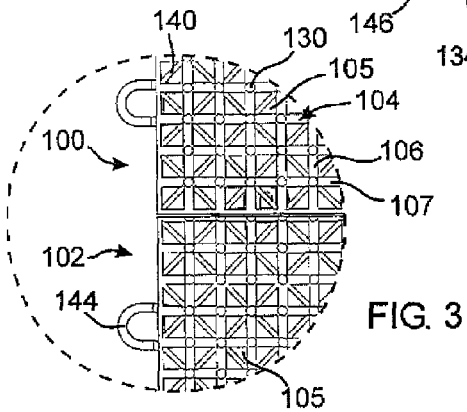
FIG. 3 is a magnified inset of a portion of the modular floor tiles of FIG. 2.
Figure 2:
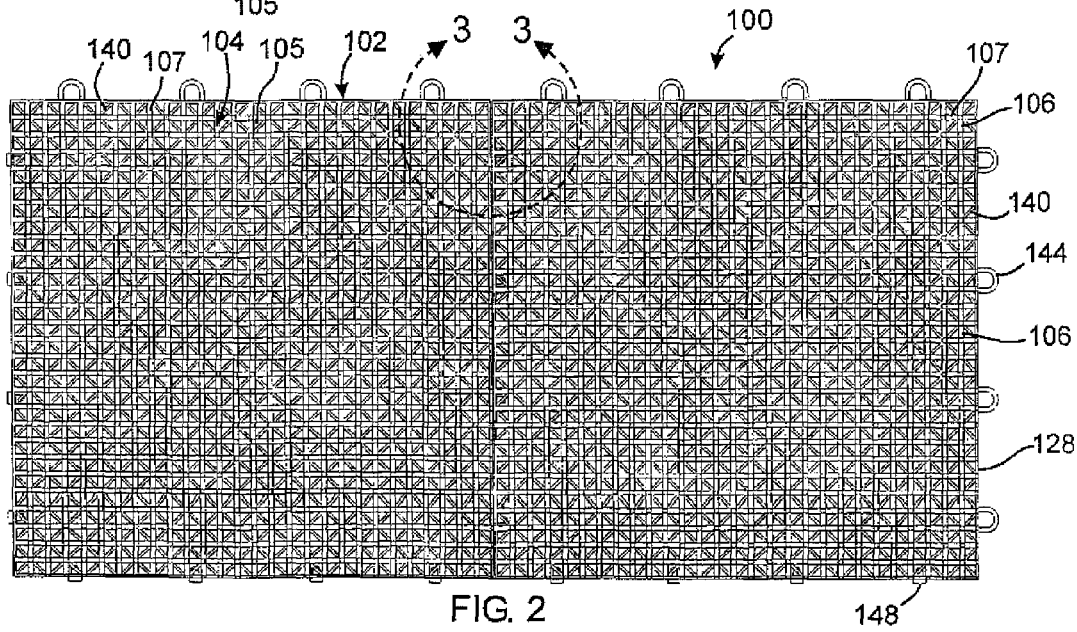
FIG. 2 is an assembled top view of the modular floor tiles of FIG. 1.

Referring now to the drawings, FIGS. 1-3 illustrate in partial assembly view modular floor tiles 100, 102 according to one embodiment. The modular floor tiles 100, 102 of FIGS. 1-3 may comprise injection molded plastic or other material. The modular tiles 100, 102 and other similar or identical tiles may be interlocked according to principles described herein to form a floor, such as a sports court floor discussed below with reference to FIG. 9. However, unlike conventional modular flooring systems, the modular tiles 100, 102 facilitate extra traction and/or debris blocking capability.

The modular tiles 100, 102 comprises a first or top open surface 104 and a plurality of edge surfaces 122, 124, 126, 128. The term "open" indicates that the top open surface 104 includes open holes, gaps, or spaces through which fluid may drain. For example, the modular tile 100 of FIGS. 1-3 may include a plurality of rectangular or square holes 105 patterned relative to the rectangular or square shape of the modular tile 100 as shown. However, any other shape for the holes 105 and the modular tile 100 may also be used.

Each of the holes 105 in the top open surface 104 is formed by a plurality of crossing surface members such as a first and a second set of spaced ribs 106, 107. The first set of spaced ribs 106 is arranged in a first direction and parallel to one another. The second set of space ribs 107 is arranged in a second direction and also parallel to one another. The first and second sets of spaced ribs 106, 107 may cooperate as shown in FIGS. 1-4 to create the top open surface 104.

Figure 4A:
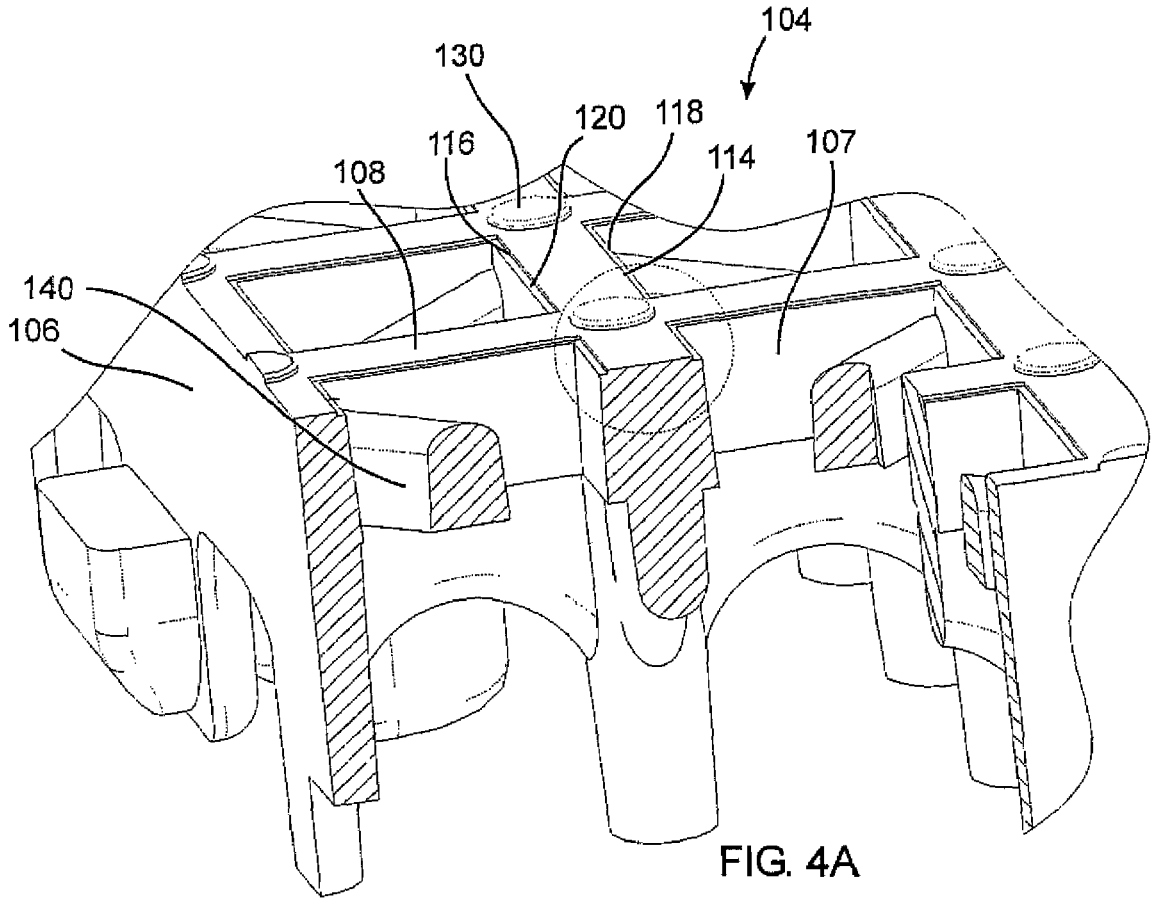
FIG. 4A is a cross-sectional view, take along line 4-4, of the modular floor tiles of FIG. 1.
Figure 4B:
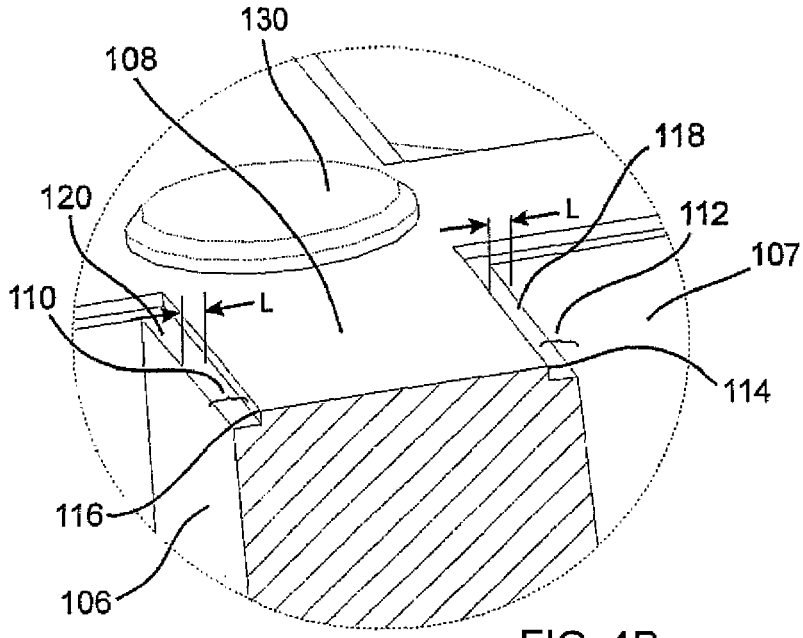
FIG. 4B is a magnified inset of FIG. 4A.
Figure 5:
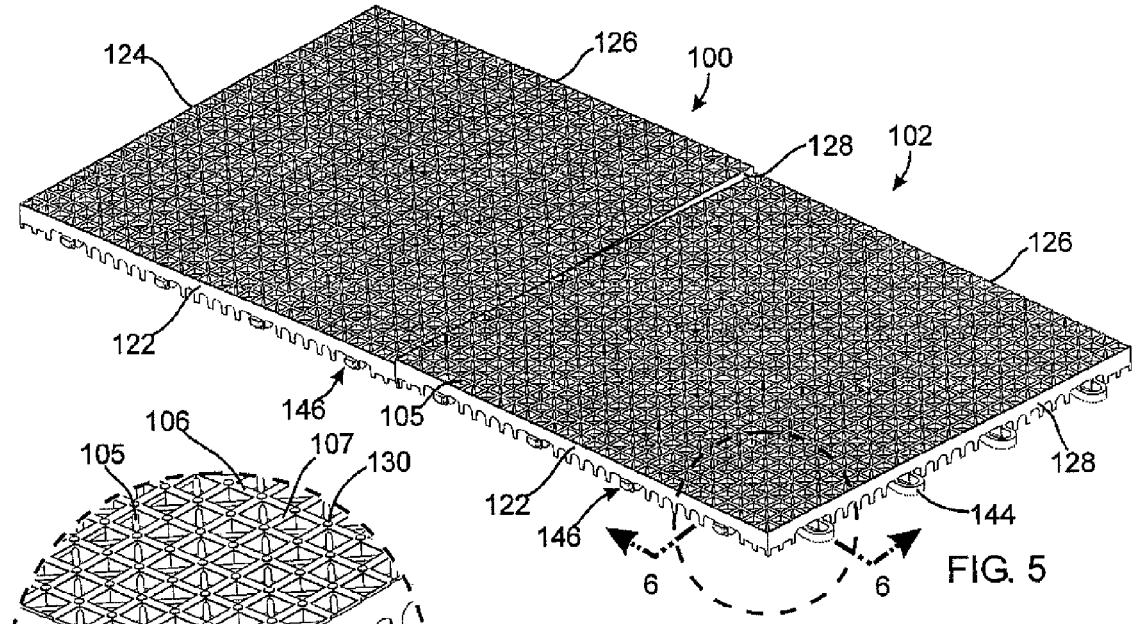
FIG. 5 is a perspective assembly view of the modular floor tiles according to one embodiment.

As shown in the detailed cross-sectional view of FIGS. 4A-4B, the first and second sets of ribs 106, 107 have a primary or central top portion 108 and opposite edge portions 110, 112. In one embodiment, the opposite edge portions 110, 112 each include a step 118, 120, respectively, down from a first elevation corresponding with the surface of the central top portion 108. The steps 118, 120 down at the opposite edge portions 110, 112 provide additional traction corners 114, 116 that enhance a user's traction across the open surface 104. The steps 118, 120 may be square or otherwise shaped, and the steps 118, 120 may be tapered to a lower elevation as well.

According to the embodiment of FIGS. 1-4B, all of the ribs 106, 107 include the steps 118, 120 in the opposite edge portions 110, 112. However, some embodiments may include steps in only a fraction of the edge portions 110, 112. The steps 118, 120 down may be equal as shown in FIGS. 1-4B, or each of the steps 118, 120 may be of slightly different height. In one embodiment, the lower elevation of the steps 118, 120 is offset from the top open surface 104 by approximately 0.0725 inches. According to some embodiments, lower elevation is offset down from the top open surface 104 by a distance ranging between 0.01 and 0.1 inches. In one embodiment, a length L of each of the opposite edge portions 110, 112 is the same and equal to approximately 0.01 to 0.1 inches. In one embodiment, length L is approximately 0.016 inches.

In one embodiment, shown in FIGS. 1-4B, the modular floor tiles 100, 102 and the top surfaces 104 are rectangular and square, and the edge surfaces 122, 124, 126, 128 form the sides of a square. In addition, the first set of spaced ribs 106 is arranged generally parallel to the first edge surface 122 and the third edge surface 126. Similarly, the second set of spaced ribs 107 is generally parallel to the second and fourth edge surfaces 124, 128. Accordingly, the first and second sets of spaced ribs 106, 107 are orthogonal. The adjacent edge surfaces 122, 124, 126, 128 are likewise orthogonal. The orthogonal, intersecting sets of spaced ribs 106, 107 form a plurality of congruent rectangles or squares in some embodiments. In one embodiment, a protrusion 130 extends from the top surface 104 at one or more intersections between the first and second sets of spaced ribs 106, 107. In one embodiment, the protrusion 130 is generally circular, but other shapes including, but not limited to, squares, rectangles, and triangles may also be used. The protrusion 130 adds another level to the top surface 104 for enhanced traction.

The square holes 105 formed by the intersecting sets of spaced ribs 106, 107 may allow the passage of debris, which is often difficult to remove. For example, leaves are often small enough to pass through the square holes 105 and lodge in or under one of the modular tiles 100, 102. Leaves and other debris can collect and result in an unattractive floor. In addition, surface tension sometimes allows water or other liquids encountered by the modular tiles 100, 102 to stretch across the square holes 105 and remain close to the top surface 104. Liquids at the top surface 104 operate as lubricants and increase the risk of slipping.

Therefore, in one embodiment, the modular floor tiles 100, 102 include a leaf blocking and/or a surface tension breaking member. In one embodiment, the leaf blocking and surface tension breaking member comprises a cross rib 140 extending between the first and second sets of spaced ribs 106, 107. The cross rib 140 may comprise a webbing extending diagonally with respect to the edge surfaces 122, 124, 126, 128 in two orthogonal directions. The cross rib 140 is arranged a non-parallel orientation with respect to any of the edge surfaces 122, 124, 126, 128. In one embodiment, the cross rib 140 is oriented between approximately twenty and seventy degrees with respect to the edge surfaces 122, 124, 126, 128. In one embodiment, the cross rib 140 is oriented at approximately forty-five degrees with respect to the edge surfaces 122, 124, 126, 128.

In one embodiment, the cross rib 140 extends diagonally across each square hole 105. The cross rib 140 may join the two nonadjacent vertices of the square forming the square hole 105. In one embodiment, the cross rib 140 is arranged at a lower elevation than the first elevation corresponding to the top open surface 104. For example, in one embodiment, the cross rib 104 is disposed at a second elevation that is approximately 0.0625 to 0.5 inches below the top open surface 104. In one embodiment, the cross rib 140 is about 0.125 inches below the first elevation. The cross rib 140 blocks the passage of leaves or other debris through the holes 105. In one embodiment, the cross rib 140 prevents leaves and other debris with dimensions meeting or exceeding 0.25 inches in length or width from passing through the holes 105. Moreover, the cross rib 140 tends to release fluid surface tension when the modular tiles 100, 102 encounter liquids. Releasing surface tension allows liquids to pass through the holes 105 and flow away from the open top surface 104 and to the ground.

As best shown in FIGS. 5-8, the two modular floor tiles 100, 102 and others may be interconnected. At least one of the side edges of the modular tiles 100, 102 includes a plurality of loops 144. However, according to the embodiment of FIGS. 5-8, a plurality of loops 144 is disposed in each of the third and fourth adjacent side surfaces 126, 128. The loops 144 may be spaced along the third and fourth side surfaces 126, 128 at substantially equal intervals.

Each of the plurality of loops 144 is receptive of a mating locking tab assembly 146 from an adjacent modular tile. According to the embodiment of FIGS. 5-8, each of the first and second adjacent side surfaces 122, 124 includes a plurality of locking tab assemblies 146. The modular tiles 100, 102 may include an equal number of locking tab assemblies 146 and loops 144. Moreover, the locking tab assemblies 146 may be spaced at the same intervals as the loops 144.

Figure 6:
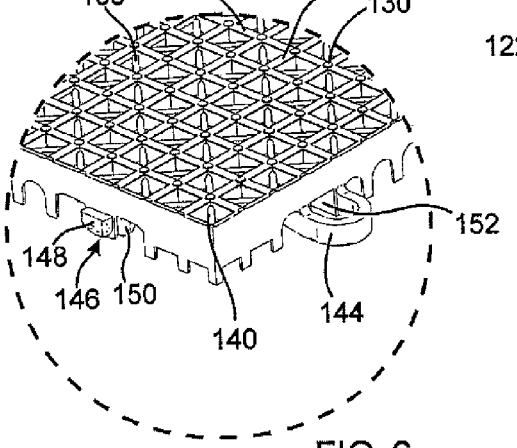
FIG. 6 is a magnified inset of FIG. 5.
Figure 7:
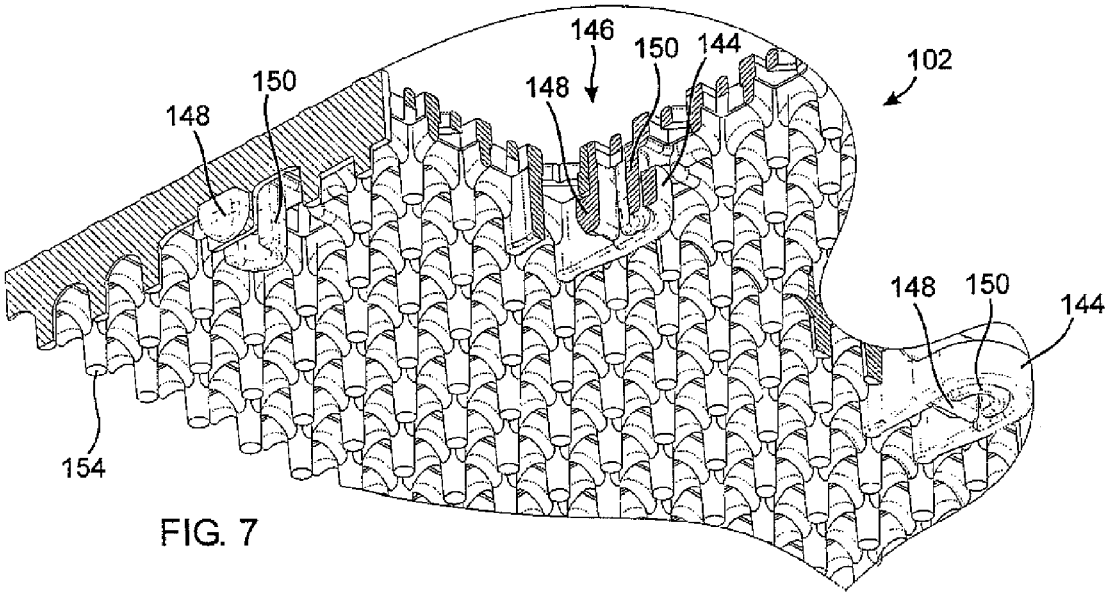
FIG. 7 is partial cross sectional view of the modular floor tiles of FIG. 5 taken along line 7-7 and illustrating the connection between tiles according to one embodiment.

Referring now to FIG. 7, the loops 144 of the modular tile 100 are receptive of the locking tab assemblies 146 (FIG. 6) of an adjacent modular tile such as the second tile 102. Thus, the first and second modular tiles 100, 102 may be interlocked or connected together. FIG. 7 illustrates the modular tiles 100, 102 already interconnected.

Figure 8:
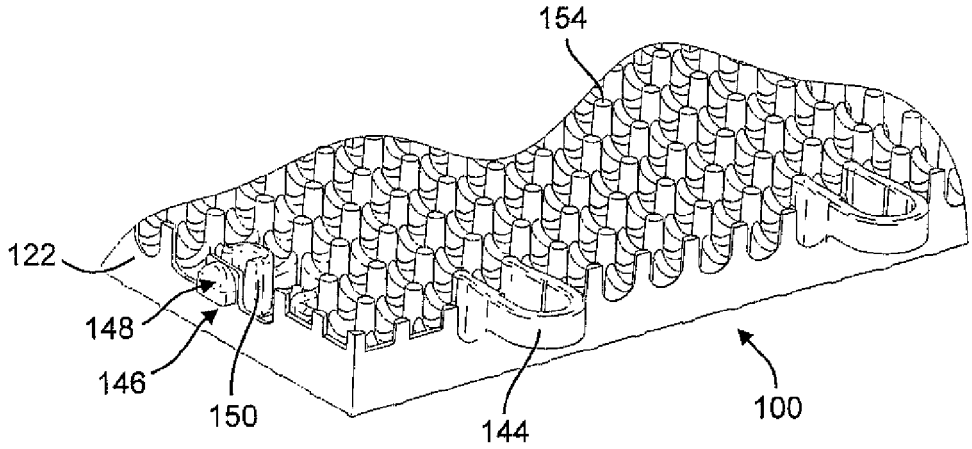
FIG. 8 is a partial bottom assembly view the modular floor tile of FIG. 1.

FIG. 8 best illustrates the components of one embodiment of the locking tab assemblies 146. The locking tab assemblies 146 comprise first and second cantilevered members 148, 150 that are moveable relative to one another. The first cantilevered member 148 protrudes from the edge surface 122 and may comprise a semi-circular tab. The second cantilevered member 150 sets behind the first cantilevered member 148 and may comprise a semicircular shell arranged transverse to the semi-circular tab. When one of the loops 144 initially engages one of the locking tab assemblies 146, the first and second cantilevered members 148, 150 flex towards one another, allowing the loop 144 to completely surround the first and second cantilevered members 148, 150. The first cantilevered member 148 remains flexed until the semi-circular tab slides past the side wall 128 and releases into an open nest 152 (FIG. 6) under the floor tile 100. When the first cantilevered member 148 enters the nest 152 (FIG. 6), the flex in the first and second cantilevered members 148, 150 releases and the locking tab assembly 146 is locked in the loop 144. In one embodiment, the semicircular curve of the second cantilevered member 150 may match the inside curve of the loop 144, and the semi-circular tab of the first cantilevered member 148 is size to fit into the nest 152 (FIG. 6). The interconnection between adjacent modular tiles 100, 102 may permit some relative displacement both vertically and laterally after the first cantilevered member 148 enters the nest 152, and provides a more comfortable feel to users, especially at quick stops and starts.

However, although some embodiments facilitate lateral displacement between interlocked modular tiles, a complete floor may tend to look sloppy and misaligned in some configurations. Therefore, according to some embodiments, adjacent modular tiles may be biased or spring loaded to a specific, generally equal spacing therebetween. Referring to FIG. 1, one or more of the side walls 122-128 may include one or more biasing members such as spring fingers 134 disposed therein. The spring fingers 134 may comprise cantilevered, angled spring fingers spaced between the loops 144 and disposed in both of the third and fourth side walls 126, 128. Nevertheless, the spring fingers 134 may just as effectively be placed in the first and second side walls 122, 124, or even in all four side walls. The spring fingers 134 thus tend to bear against adjacent side walls of adjacent tiles, aligning all of the modular floor tiles in a floor to a substantially equal spacing, while also permitting lateral displacement upon the application of a sufficient lateral force.

Each of the modular tiles 100, 102 includes a support system under the top open surface 104. According to some aspects, the support system comprises a single-tier suspension system. One embodiment of the single-tier suspension system is illustrated in FIGS. 7-8, and comprises a plurality of support legs 154 extending down from the first open surface 104 (FIG. 1). The support legs 154 may be of substantially equal length. However, one embodiment includes a support system comprising multiple tiers. For example, the support legs 154 may alternate between two different lengths. Therefore, absent a load, only the longer set of support legs contacts the ground, while loads may cause the shorter set of support legs to contact the ground. A multiple-tier suspension facilitates vertical flexing or springing of each of the modular tiles 100, 102 (FIG. 1). That is to say, as a load is applied to one or more of the modular tiles 100, 102 (FIG. 1) on the first open surface 104 (FIG. 1), the first open surface 104 (FIG. 1) "gives" or tends to flex, until the second shorter set of support legs contacts the ground. Accordingly, application of the principles described herein may result in a comfortable spring-like modular floor.

Figure 9:
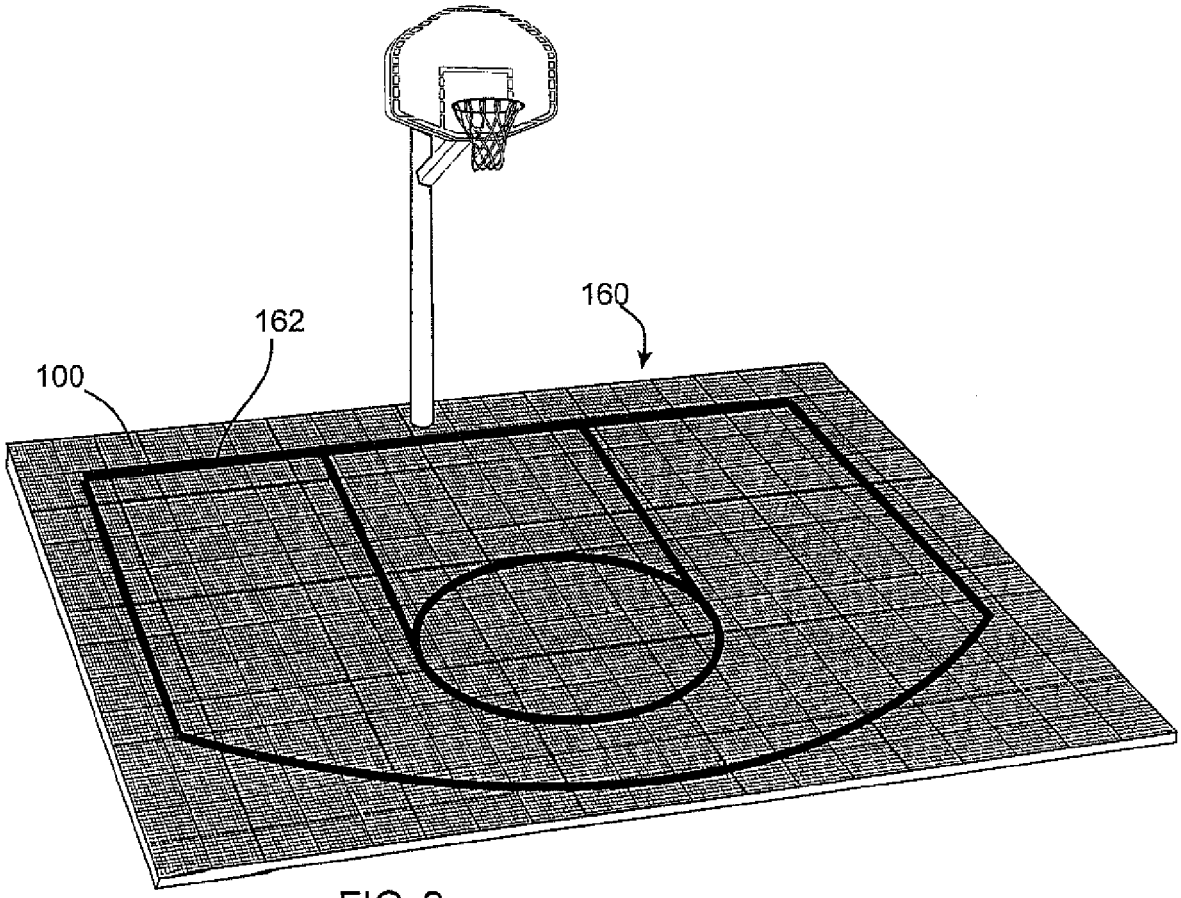
FIG. 9 is a perspective view a modular floor arranged as a sports court according to one embodiment.

The modular tiles 100, 102 (FIG. 1) described above, along with a plurality of additional similar or identical modular tiles, may be arranged in any configuration to create a floor. For example, as shown in FIG. 9, a plurality of modular tiles 100 may be arranged to form a sports court floor 160. The sports court floor 160 may include lines corresponding to regulation sports floor lines, such as the basketball court lines 162 shown in FIG. 9. The lines may be painted onto or otherwise formed in the modular tiles 100.

For many uses of the modular tiles 100, including the sports court floor 160, traction can be important. Therefore, the steps 118, 120 (FIG. 4B) provide a significant advantage over traditional modular floors. According to some embodiments, the modular tiles 100, 102 include multiple traction layers. For example, as shown in FIGS. 1-4B, the modular tiles 100, 102 comprise three traction layers. A first of the three traction layers may comprise the top surface 104 comprising the central portion 108 of the rib sets 106, 107. A second of the three traction layers may comprise the steps 118, 120 or the corners 114, 116. The protrusions 130 from the top surface 104 may comprise a third traction layer.

Referring again to FIG. 1, according to some aspects, the modular floor tiles 100, 102 may be made by providing a mold, injecting liquid polymer into the mold, shaping the liquid polymer with the mold to provide a top surface 104 and the steps 118, 120 in the spaced rib sets 106, 107, and solidifying the liquid polymer. The cross ribs 140 may also be formed in the modular floor tiles 100, 102 at an elevation lower than the top surface 104. The shaping of the modular tiles 100 may comprise creating the plurality of loops 144 disposed in at least one side edge 128, and creating a plurality of locking tab assemblies 146 disposed in at least one other side edge 122.

The preceding description has been presented only to illustrate and describe exemplary embodiments. It is not intended to be exhaustive or to limit the claims. Many modifications and variations are possible in light of the above teaching. The scope of the invention is defined by the following claims.

The invention claimed is:

1. A modular floor tile, comprising:

a first open top surface;

a plurality of edge surfaces;

an interlocking mechanism for attachment to adjacent tiles;

a plurality of crossing surface members defining the first open surface, each of the plurality of crossing surface members comprising:

a central top portion;

opposing side portions;

a first set of spaced ribs generally parallel to a first of the plurality of edge surfaces;

a second set of spaced ribs generally parallel to a second of the plurality of edge surfaces, the first and second edge surfaces being orthogonal;

a protrusion extending upwardly from each intersection between the first and second sets of spaced ribs;

a step disposed in the side portions, wherein the step is disposed in the side portions at an elevation below the central top portion and includes first and second step surfaces that intersect each other.

2. A modular floor tile according to claim 1 wherein the step disposed in the side portions is a generally square step down from the central top portion.

3. A modular floor tile according to claim 1 wherein the protrusion is generally circular.

4. A modular floor tile according to claim 1 wherein the first open top surface comprises a rectangle, and the plurality of crossing surface members form a plurality of congruent rectangles.

5. A modular floor tile according to claim 1 wherein the first open top surface comprises a square, and the plurality of crossing surface members form a plurality of congruent squares.

6. A modular floor tile according to claim 1 wherein the first open top surface comprises a first elevation; and further comprising:

a cross rib extending between the crossing surface members at a second elevation below the first elevation.

7. A modular floor tile according to claim 1 wherein the first open top surface comprises a first elevation; and further comprising:

a cross rib extending diagonally between the crossing surface members at a second elevation below the first elevation.

8. A modular floor tile according to claim 1 wherein the first and second sets of ribs forming a plurality of rectangles;

a lower rib extending diagonally between each of the plurality of rectangles at an elevation below the first open surface.

9. A modular floor tile according to claim 1 wherein the first and second step surfaces are arranged generally perpendicular to each other.

10. An apparatus, comprising:

a modular floor, the modular floor comprising:

a plurality of interlocking tiles, each of the plurality of interlocking tiles comprising:

a top surface comprising a plurality of open holes, wherein the top surface further comprises a plurality of edges and a step disposed in each edge, wherein the step is disposed in each edge at an elevation below the top surface, and wherein the step includes first and second step surfaces that intersect each other, wherein the plurality of open holes are defined by a plurality of crossing members that comprise:

a first set of spaced ribs generally parallel to a first of the plurality of edges;

a second set of spaced ribs generally parallel to a second of the plurality of edges, the first and second edge surfaces being orthogonal;

a protrusion extending upwardly from each intersection between the first and second sets of spaced ribs;

a lower rib disposed across each of the plurality of open holes at an elevation below the top surface;

wherein each of the plurality of interlocking tiles comprises four edge surfaces forming a rectangle, and wherein the lower rib is arranged diagonal to the four edge surfaces.

11. An apparatus according to claim 10 wherein the plurality of crossing members form squares, and wherein the lower rib is arranged diagonal to the squares.

12. An apparatus according to claim 10 wherein the plurality of crossing members form squares, each of the crossing members having opposing edges comprising a step down from the top surface.

13. An apparatus according to claim 10 wherein the first and second step surfaces are arranged perpendicular to each other.

14. An apparatus, comprising:

a modular floor, the modular floor comprising:

a plurality of interlocking tiles, each of the plurality of interlocking tiles comprising:

a top surface structure comprising a plurality of open holes, wherein the top surface structure further comprises a plurality of edges and a step disposed in each edge, wherein the step is disposed in each edge at an elevation below the top surface structure, and wherein the step includes first and second step surfaces that intersect each other, wherein the plurality of open holes are defined by a plurality of crossing members that comprise:

a first set of spaced ribs generally parallel to a first of the plurality of edges;

a second set of spaced ribs generally parallel to a second of the plurality of edges, the first and second edge surfaces being orthogonal;

a protrusion extending upwardly from each intersection between the first and second sets of spaced ribs;

a leaf blocking member disposed across each of the plurality of open holes at an elevation below the top surface structure.

15. An apparatus according to claim 14 wherein the leaf blocking member is sized to block leaves of 0.25 inches across and larger from passing through the open holes.

16. An apparatus according to claim 14 wherein the leaf blocking member comprises a rib extending diagonally across each of the plurality of open holes.

17. An apparatus according to claim 14 wherein the leaf blocking member is non-parallel to any sides of the interlocking tiles.

18. An apparatus according to claim 14 wherein the first and second step surfaces are arranged generally perpendicular to each other.

19. An apparatus, comprising:

a rectangular modular tile, the rectangular modular tile comprising:

a top surface comprising a plurality of open holes wherein the top surface further comprises a plurality of edges and a step disposed in each edge, wherein the step is disposed in each edge at an elevation below the top surface, and wherein the step includes first and second step surfaces that intersect each other, wherein the plurality of open holes are defined by a plurality of crossing members that comprise:

a first set of spaced ribs generally parallel to a first of the plurality of edges;

a second set of spaced ribs generally parallel to a second of the plurality of edges, the first and second edge surfaces being orthogonal;

a protrusion extending upwardly from each intersection between the first and second sets of spaced ribs;

four edge surfaces defining a perimeter of the rectangular tile;

a rib disposed across each of the plurality of open holes in a non-parallel orientation with respect to any of the four edge surfaces.

20. An apparatus according to claim 19 wherein the rectangular modular tile comprises a square.

21. An apparatus according to claim 19 wherein the rib is oriented between approximately 20 and 70 degrees with respect to the four edge surfaces.

22. An apparatus according to claim 19 wherein the rib is oriented at approximately 45 degrees with respect to the four edge surfaces.

23. An apparatus according to claim 19 wherein the rib is diagonal to the four edge surfaces.

24. An apparatus according to claim 19 wherein the rib comprises a lower elevation than the top surface.

25. An apparatus according to claim 19 wherein the top surface comprises a plurality of rectangles, each rectangle comprising an inside and an outside edge, wherein each of the inside and outside edges comprise a step.

26. An apparatus according to claim 19 wherein the top surface comprises a plurality of rectangles, each rectangle comprising an inside and an outside edge, wherein each of the inside and outside edges comprise a step, wherein the step is 0.05 inches down from the top surface.

27. An apparatus according to claim 19, further comprising a plurality of the rectangular modular tiles interconnected to form a sports court, each of the plurality of rectangular modular tiles comprising:

a top surface comprising a plurality of open holes;

four edge surfaces defining a perimeter of the rectangular tiles;

a rib disposed across each of the plurality of open holes in a non-parallel orientation with respect to any of the four edge surfaces;

a step in all side edges defining the plurality of open holes.

28. An apparatus according to claim 19 wherein the first and second step surfaces are arranged generally perpendicular to each other.

* * * * *